US007007636B2

(12) United States Patent
Schlesser et al.

(10) Patent No.: US 7,007,636 B2
(45) Date of Patent: Mar. 7, 2006

(54) FUEL SYSTEM FOR PREMIX BURNER OF A DIRECT-FIRED STEAM GENERATOR

(75) Inventors: Wlater Mark Schlesser, Ottumwa, IA (US); Timothy James Kraus, Hedrick, IA (US); Philip Alan Harden, Bloomfield, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/883,866

(22) Filed: Jul. 2, 2004

(65) Prior Publication Data

US 2006/0000426 A1 Jan. 5, 2006

(51) Int. Cl.
*F22D 7/12* (2006.01)

(52) U.S. Cl. ..... 122/448.1; 122/446

(58) Field of Classification Search ..... 122/448.1, 122/451 R, 452, 446, 450
See application file for complete search history.

(56) References Cited

U.S. PATENT DOCUMENTS 4,211,071 A 7/1980 Wyatt
4,462,342 A * 7/1984 Welden ..... 122/448.1
4,508,064 A * 4/1985 Watanabe ..... 123/1 A
5,685,707 A 11/1997 Ramsdell et al.
6,135,063 A 10/2000 Welden

* cited by examiner

*Primary Examiner*—Gregory Wilson

(57) ABSTRACT

A direct-fired, propane powered steam generator is provided with a carburetor, which receives vaporized propane from a converter arrangement which converts liquid propane to vapor, receives pressurized air and feeds a mixture of vaporized propane and air into the combustion chamber of the steam generator. The amount of air delivered to the carburetor is variable, with the amount of vaporized propane entering the carburetor being determined by the position of a metering valve which varies in accordance with the amount of air passing through the carburetor. The converter arrangement receives liquid propane and is coupled to process water heated in the water jackets of the combustion chamber and adjacent structure, the converter arrangement being designed so that heat from the water is transferred for effecting vaporization of the liquid propane. The flow of liquid propane for combustion in a pilot burner and for combustion in the main combustion chamber may be controlled using various arrangements of solenoid-operated lock off valves and/or vacuum-operated fuel lock off filters and/or air pressure balance control valves.

4 Claims, 6 Drawing Sheets

FUEL SYSTEM FOR PREMIX BURNER OF A DIRECT-FIRED STEAM GENERATOR

FIELD OF THE INVENTION

The present invention relates to direct-fired steam generators, and, more specifically, relates to systems for supplying a combustible mixture of fuel and air to the premix burners of such generators.

BACKGROUND OF THE INVENTION

Applications in which a forced airflow is used with a premix burner require a high-pressure fuel delivery system in order to overcome the high air pressures (generally from 2~15 psi) in the burner. In the present systems, fuel is metered in a binary fashion using several solenoid valves (see U.S. Pat. Nos. 6,135,063 and 4,462,342, for example) or with electronic controls utilizing several sensors and valves (see U.S. Pat. No. 5,685,707, for example).

A typical known premix burner layout includes main fuel and air passages which merge at a burner inlet and are fed into the burner combustion chamber where the mixed fuel and air are ignited. Water for producing steam is introduced into an inlet at one end of the chamber and moves along an inner surface of the chamber toward an outlet at an opposite end of the chamber. Combustion occurs centrally within the chamber and the heat generated changes the water to steam. U.S. Pat. No. 4,211,071 discloses such a system. Systems of this type having fuel metered in the known ways have one or more of the following drawbacks: (1) the burner's output is changed in a step progression, with each step depending on the size and quantity of valves opened to regulate the fuel/air mixture; (2) fuel flow is often not related to the airflow through the burner; (3) to have a variety of firing rates, either a fuel flow control system including several fuel valves is needed, or a complicated variable valve system is needed, with either system adding great expense while decreasing overall reliability; and requiring a high amount of piping which makes them undesirable for mobile application.

It is desirable then to overcome the cost and complexity of current fuel systems for premix burners of direct-fired steam generators, while improving the firing rate control.

SUMMARY OF THE INVENTION

According to the present invention, there is provided an improved fuel control system for a direct-fired steam generator.

An object of the invention is to provide a fuel control system which is of a relatively low cost and which provides an infinite firing rate adjustment within the desired operating range of the steam generator.

The above-noted object is achieved by using off-the-shelf engine fuel control components laid out to form a fuel delivery system similar to that of a supercharged, or turbocharged, engine fuel delivery system.

In a standard carburetor system, the engine's pistons, while moving to bottom dead center, create a low-pressure area on the back or downstream side of the carburetor. Ambient air moves through the carburetor into the low-pressure area. As the air moves through the carburetor, a pressure drop occurs lifting a diaphragm-controlled fuel metering valve so as to allow fuel to flow. The amount of air moving through the system affects the amount of diaphragm movement, and, hence, the amount of fuel flow.

In a supercharged or turbocharged engine system, the air entering the carburetor is at an elevated pressure. A pressure-balance air line is connected from the downstream side of the carburetor to the diaphragm. This equalizes the pressure on the diaphragm and allows its movements to be controlled by the pressure drop through the carburetor. Instead of creating a low-pressure downstream of the carburetor, one can create a high pressure upstream of the carburetor. By using a blower or other air-pumping device to force air through the carburetor, one can induce the proper fuel flow into the air stream.

The present invention is achieved then by replacing the head or entry end of a known premix burner, where the combustion air and fuel meet before entering the combustion chamber, by a carburetor which controls the amount of fuel as a function of the amount of air flowing through the carburetor. A variable output air pump, such as is manufactured by the Magnuson division of Eaton Corporation, for example, is provided for controlling the amount of air delivered to the carburetor, and, hence the amount of fuel. A standard blower with a binary air bleed-off control could also be used.

DESCRIPTION OF THE PREFERRED EMBODIMENT

Figure 1:
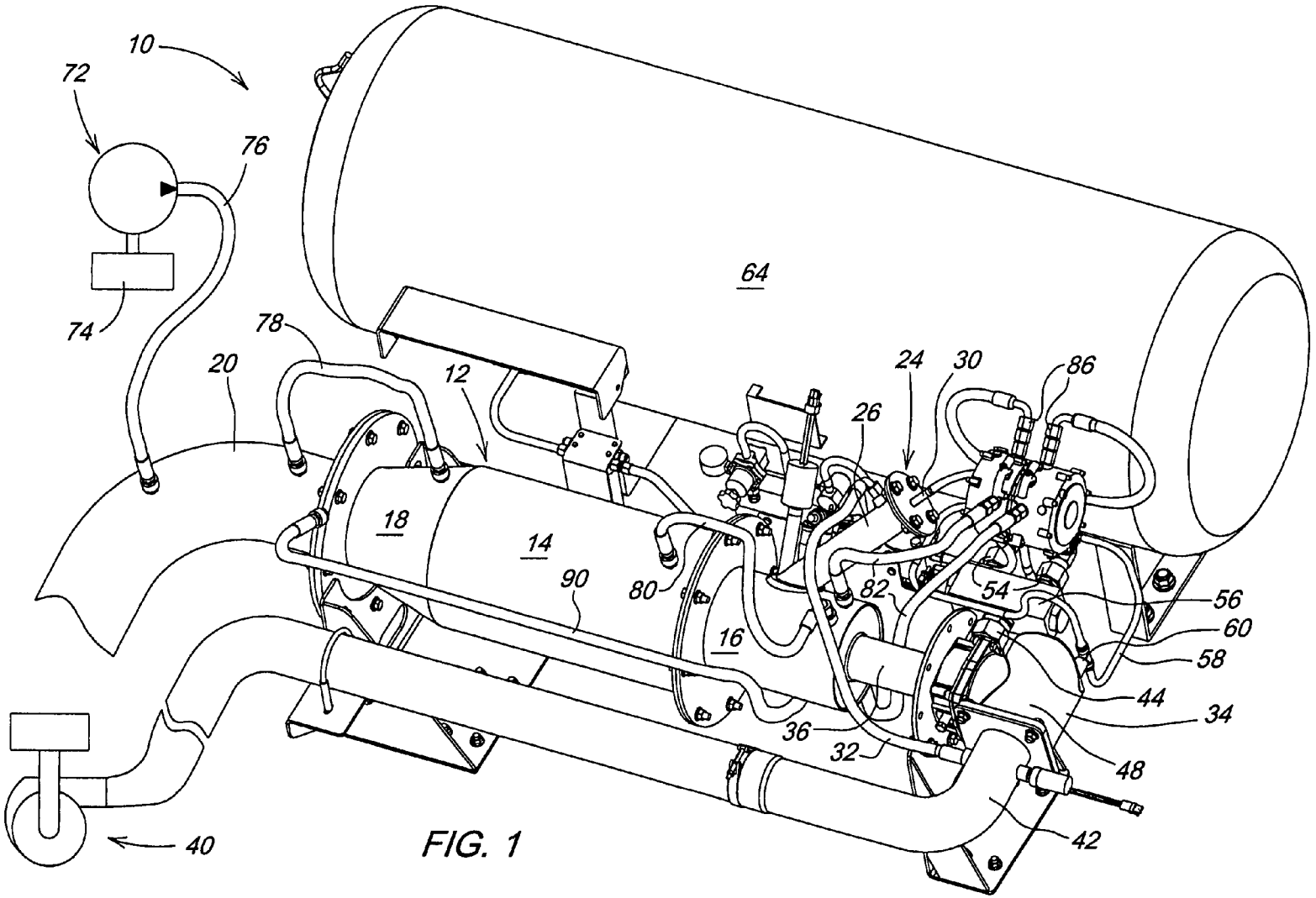
FIG. 1 is a somewhat schematic perspective view of a direct-fired steam generator system including a carburetor for controlling the air/fuel mixture used in the combustion chamber of the steam generator.
Figure 2:
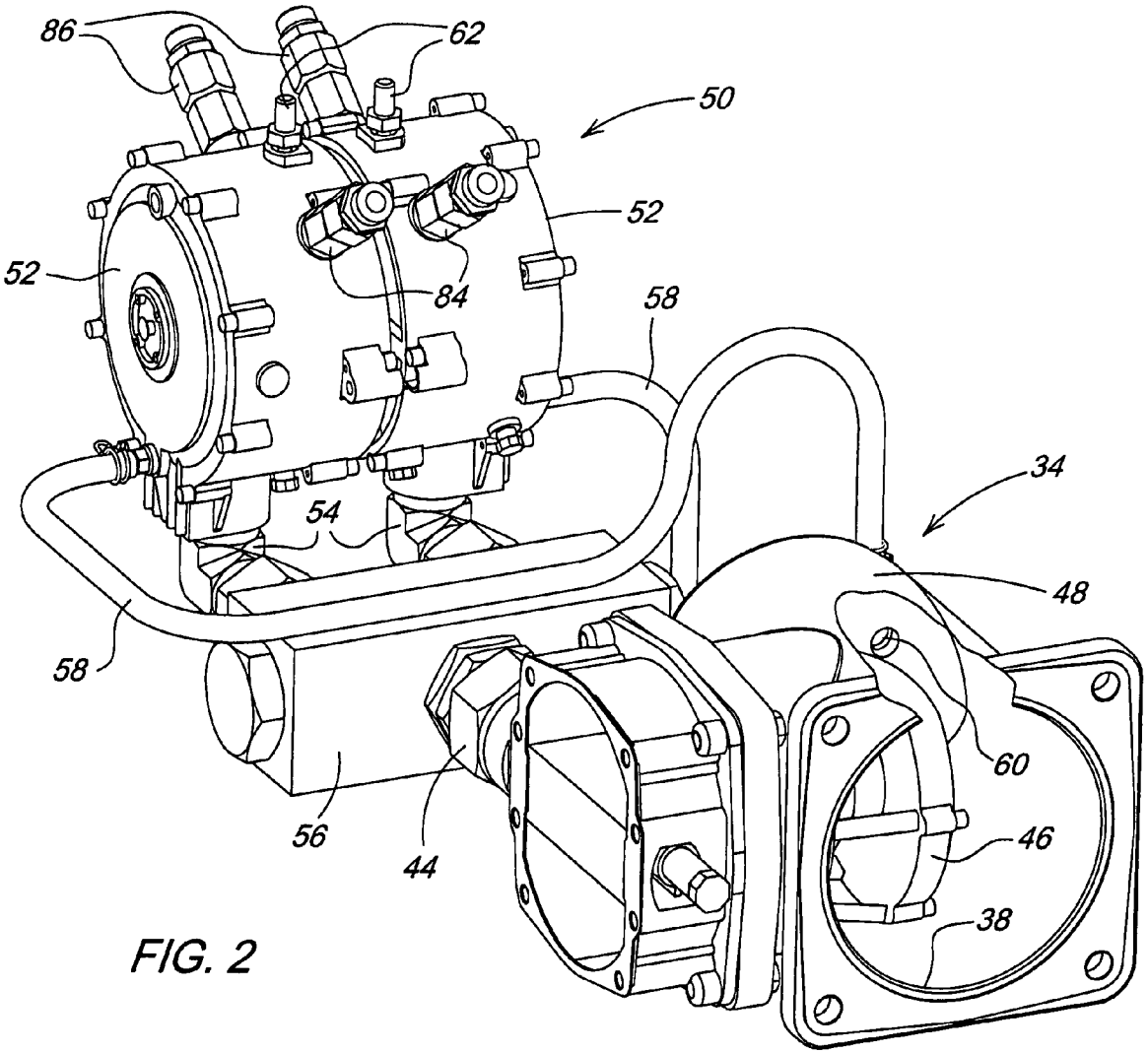
FIG. 2 is an enlarged perspective view of a portion of the steam generator of FIG. 1 showing the converter coupled for supplying propane vapor to the fuel inlet of the carburetor.
Figure 3:
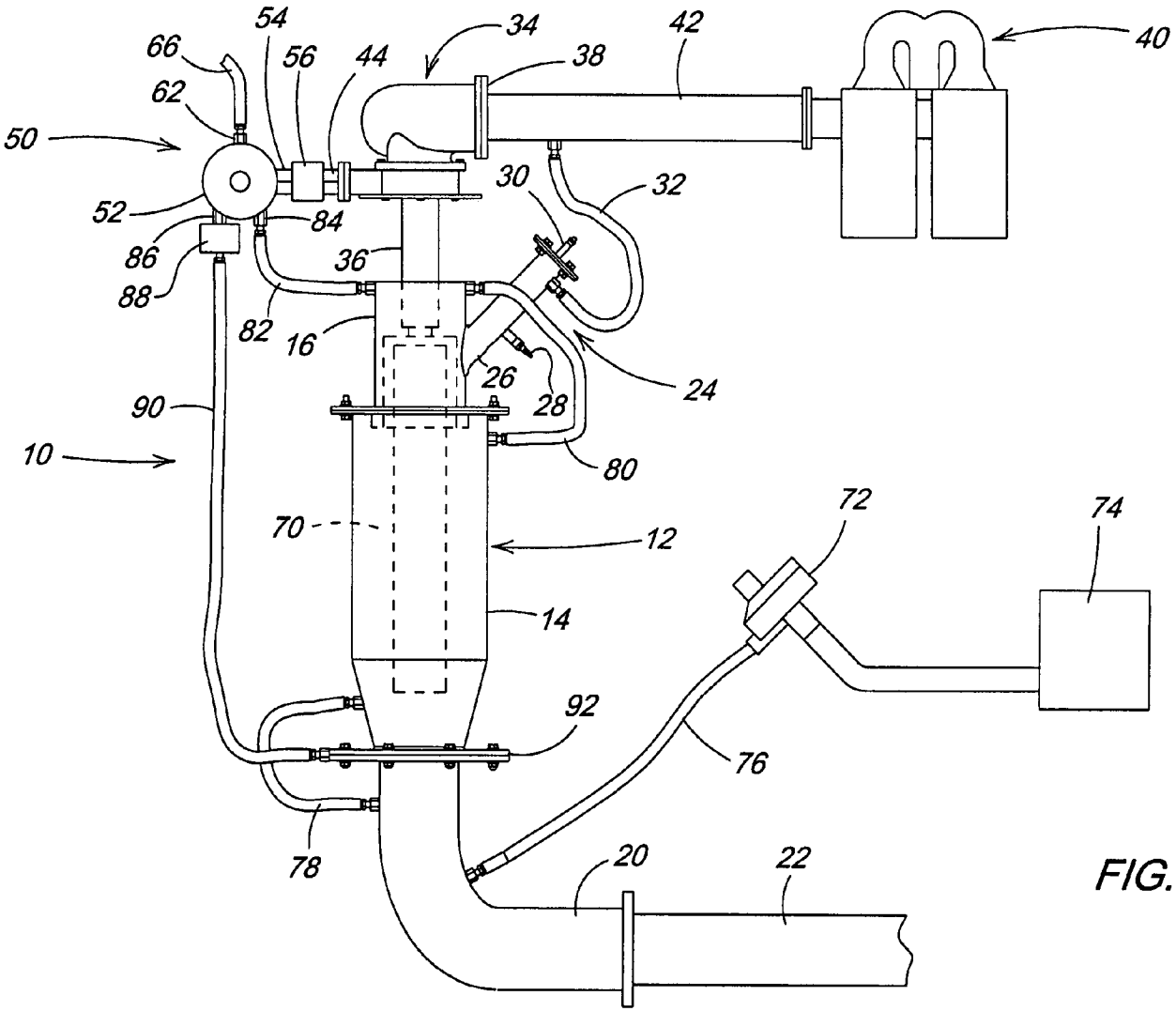
FIG. 3 is a partial sectional view of the steam generator omitting most of the fuel supply system but showing the water and air supply systems.

Referring now to FIGS. 1–3, there is shown a steam generator assembly 10 including a steam generator body 12 having a cylindrical inlet section 14 to which a cylindrical burner-head 16 is coupled, and having a conical outlet section 18 to which one end of an elbow 20 is coupled, the other end of the elbow 20 being coupled to a static mixer 22 (FIG. 3). A pilot burner arrangement 24 includes a tube 26 mounted so as to project through and terminate at an interior surface of a lower region of the burner-head 16. An igniter 28, which may be a spark plug or other type of sparking device, is mounted to the tube 26 so as to selectively create a spark at an interior location of the tube 26 for igniting a fuel/air mixture resulting when vaporized fuel enters by way of a pilot fuel inlet 30 provided in a cover at an inlet end of the tube 26 and when air enters by way of an pilot burner air line 32 coupled to an upper location of the tube 26.

A carburetor 34 has an outlet coupled to an inlet end of the burner-head 16 by a short tube 36, and has a main combustion air inlet 38 (FIGS. 2 and 3) coupled for receiving pressurized air from a variable output air pump arrangement 40 by an air line 42. It is noted that the pilot burner air line 32 is coupled to the line 42 just upstream of the carburetor 34. The carburetor 34 also has a main combustion fuel inlet 44 coupled to an outlet end of a throttle body 46. The throttle body 46 includes a mounting portion secured to a mounting portion at an outlet of, and includes a portion projecting within, a 90° air horn 48.

A fuel converter assembly 50 includes a pair of converter units 52 respectively having a pair of gaseous fuel outlets 54 coupled to a manifold 56 including a gaseous fuel outlet coupled to the fuel inlet 44 of the throttle body 46. The amount of fuel entering the throttle body 46 is metered by the action of a metering valve which is actuated in accordance with a pressure drop across a diaphragm of a diaphragm and metering valve assembly 47 (see FIGS. 4–6) located within the carburetor 34. Air flow through the carburetor 34 is caused by the introduction of high pressure air at the air inlet 38. The influence of the pressure of the inlet air acting on the diaphragm of the assembly 47 is nullified by a pair of pressure balance lines 58 coupled so that the high pressure at an upstream side of the diaphragm is transferred to the downstream side of the diaphragm. Specifically, the pressure balance lines 58 have respective first ends coupled to the converter units 52 so as to be in communication with the gas outlets 54, and hence the downstream side of the diaphragm, and have respective second ends coupled to a T-connection 60 (FIG. 1) having an inlet coupled to the interior of the air horn 48 at a location upstream of the throttle body 36, and hence upstream of the diaphragm. The gas converter units 52 each include a liquid fuel inlet 62 coupled for receiving liquid propane from a pressurized propane tank 64 by a liquid fuel supply line 66 (FIGS. 3–6).

As can best be seen in FIG. 3, the steam generator body 12 defines an interior combustion or flame chamber 70. The generator body 12, burner-head 16 and elbow 20 are all double-walled so as to define a water jacket between the walls for containing cooling water. Cooling water is supplied by a water pump 72 having an inlet coupled to a water tank 74 and an outlet coupled by a water line 76 to an inlet provided in the outer wall of the elbow 20. The water jacket of the elbow 20 is coupled by a water transfer line 78 to the water jacket of the generator body 12, and the water jacket of the generator body 12 is coupled to the water jacket of the burner-head 16 by a water transfer line 80. A pair of water transfer lines 82 each have respective inlet ends coupled to the water jacket of the burner-head 16 and respective outlet ends respectively coupled to a pair of water inlets 84, respectively of the converter units 52. Each of the converter units 52 includes a water outlet 86 coupled, as by a T-connection 88 to an inlet of a water return line 90 having its outlet coupled to an injector assembly 92 mounted between the elbow 20 and the generator body 12 and which directs the returned water into a region at the outlet of the combustion chamber 70 where the water is contacted by the hot combustion gases and is changed to steam as it becomes mixed with these hot gases, with the static mixer 22 aiding the mixing process.

Thus, it will be appreciated that as the water delivered by the pump 72 flows from the water jacket of the elbow 20 to the water jacket of the generator body 12 to the water jacket of the burner-head 16 it will be heated and that this hot water then passes into the converter units 52 which are designed such that heat from the water is transferred to the liquid propane so as to cause the latter to vaporize or change to its gaseous state before it exits the converter units 52 at the outlets 54. In the event that the temperature of the water as it enters the converter units 52 is too high for efficient conversion of the liquid propane to gas, then the inlet ends of the water transfer lines 82 may be coupled to the water jacket of the generator body 12 at a location where the temperature of the water is more suitable for the conversion process.

Figure 4:
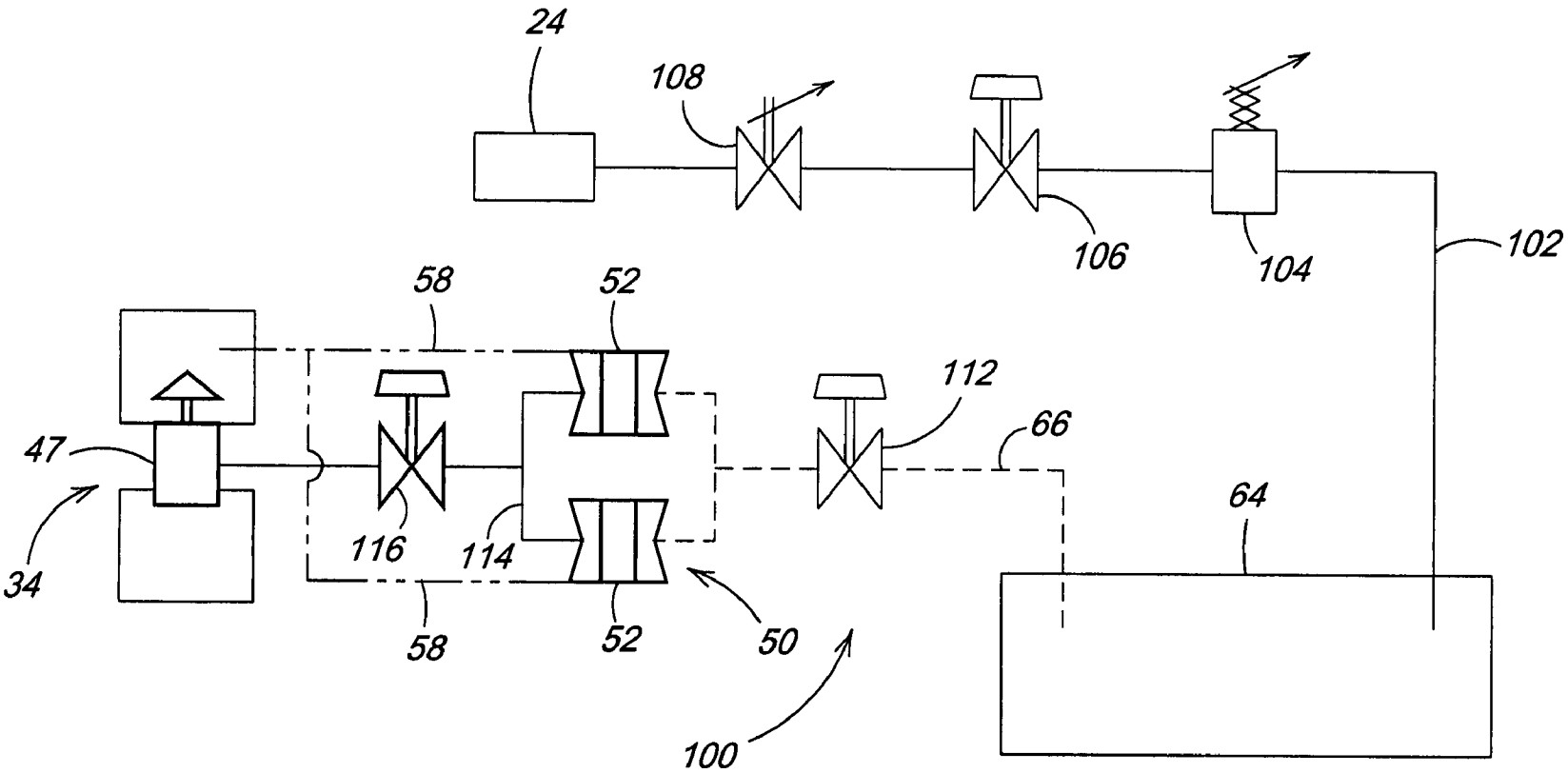
FIGS. 4, 5 and 6 are schematic representations respectively of three different fuel systems for supplying fuel to the main and pilot combustion chambers of the steam generator burner.

Referring now to FIG. 4, there is shown a fuel system 100 for supplying propane fuel to the carburetor 34 and to the pilot burner arrangement 24. Specifically, a pilot burner fuel supply line 102 is coupled between the propane tank 64 and the fuel inlet 30 at the top of the tube 26. Located in series in the fuel supply line 102, as considered proceeding from the tank 64 to the pilot burner assembly 24, are a pressure regulator 104, a normally closed, solenoid-operated fuel lock off valve 106 and a manually-operable needle valve 108. The fuel line 102 has an inlet so positioned in the tank 64 that it only accesses vaporized fuel located in the tank. The pressure regulator 104 reduces the pressure of the fuel passing beyond the regulator 104 to a desired level for proper pilot light operation. Flow to the pilot burner arrangement 24 is permitted by opening the solenoid valve 106, with this flow being tuned by adjusting the needle valve 108. The needle valve 108 may not be required if the desired flow restriction is obtained by choosing an appropriate fuel line size.

The fuel system 100 additionally includes the liquid fuel line 66 for supplying the fuel for the primary combustion that takes place in the combustion chamber 44 70 once combustion has been started by the pilot burner assembly 24. The fuel line 66 has an inlet located in the tank 40 so as to access liquid propane. The fuel line 66 contains a normally closed, solenoid-operated fuel lock off valve 112 that is located upstream of separate branches of the fuel line 66 that are respectively coupled to the liquid fuel inlets 62 of the pair of converter units 52. A vaporized fuel line 114, shown here in lieu of the manifold 56 of FIG. 2, has a branched end coupled to the vaporized fuel outlets 54 of the converter units 52 and a further end coupled to the fuel inlet 44 of the carburetor 34. Located in the vaporized fuel line 114 is a solenoid-operated, fuel vapor control valve 116. The air pressure balance lines 58 are coupled between the air horn 48 of the carburetor 34 and the converters 52 so that the flow of fuel into the carburetor 34 is metered in response to the pressure drop across the diaphragm of the carburetor diaphragm and metering valve assembly 47 for controlling the position of the fuel metering valve without being influenced by the pressure of the pressurized air entering the air horn at the inlet side of the diaphragm. Fuel flow between the tank 64 and the carburetor 34 is allowed by opening the normally closed, fuel lock off valve 112 and the fuel vapor control valve 116, with it being noted that the small amount of fuel stored between the solenoid valve 116 and the converter units 52 will not flow until the vapor control valve 116 is opened. However, it is to be noted that the valve 116 may be omitted from the control system 100, with the only change in operation being that the small amount of fuel stored between the converter units 52 and the carburetor 34 will now flow when air flow across the diaphragm-controlled metering valve causes the metering valve to open.

Figure 5:
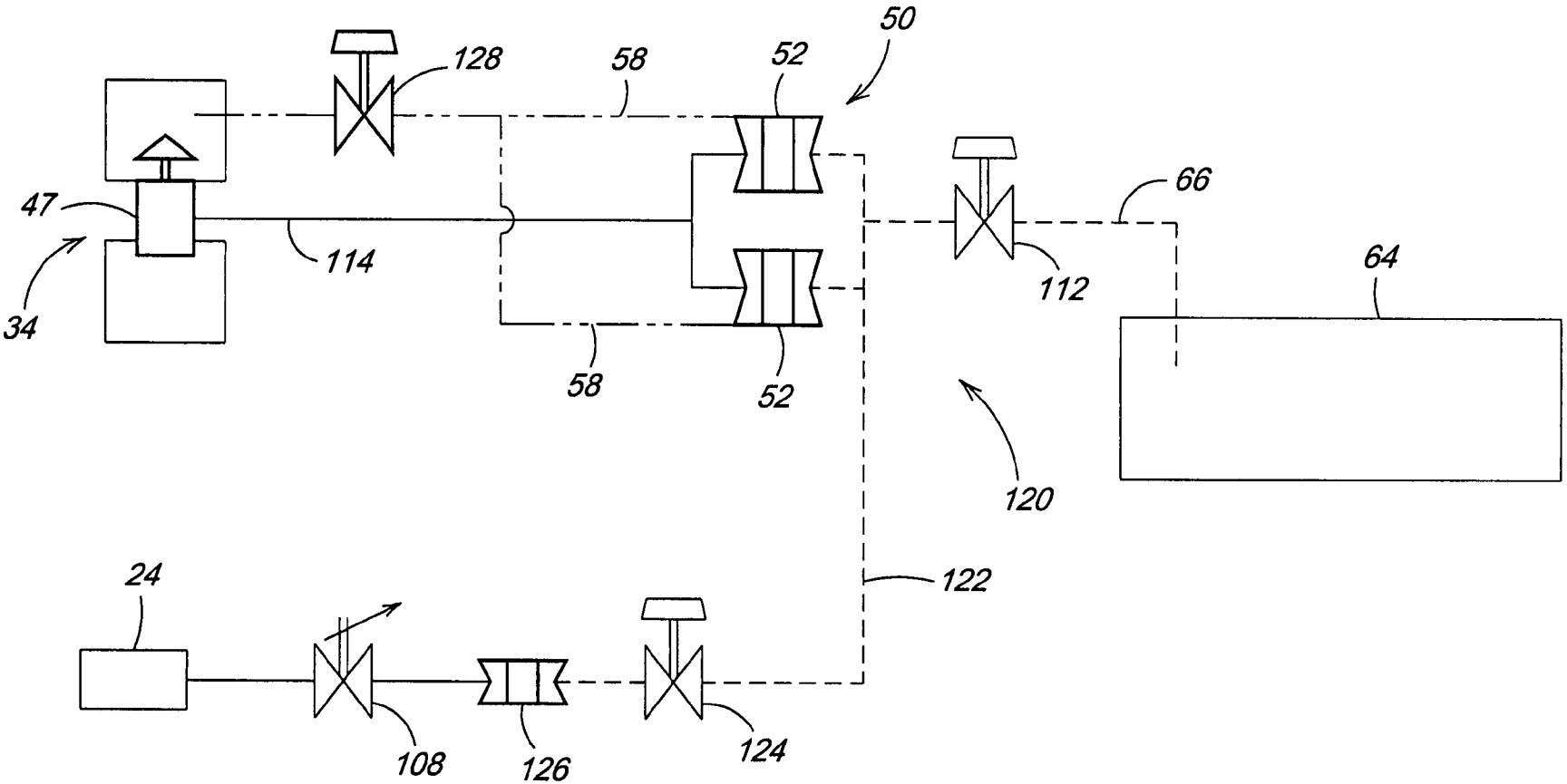

Referring now to FIG. 5, there is shown a fuel control system 120 which is a variant of the control system 100, with common parts being indicated by the same reference numerals. One of the main differences between the system 120 and the system 100 is that fuel for the pilot burner arrangement 24 is supplied by liquid withdrawn from the tank 64 by the fuel supply line 66 used for supplying the fuel for the main fire within the combustion chamber 70. Specifically, the liquid fuel supply line 66 still contains the solenoid-operated, fuel lock off valve 112 at a location upstream of a branched end of the line 66 which leads to the converter units 52. A further branch 122 is coupled to the pilot burner assembly 24 and contains a second solenoid-operated, fuel lock off valve 124. Located in the line 122 in series with, and downstream from, the valve 124 is an air heated regulator 126 and a manually-operable needle valve 128. Flow of fuel to the pilot burner assembly 24 is controlled by opening both of the solenoid-operated, fuel lock off valves 112 and 124. The liquid propane is then vaporized by the air heated regulator 126 (any source of heated air may be coupled to the regulator 126), with the flow of the vaporized fuel to the pilot burner assembly 24 being fine-tuned by operation of the needle valve 108. As previously mentioned, the needle valve 108 may be omitted and the fuel line sized to provide the desired metering.

The portion of the system 120 for supplying fuel for the main fire in the combustion chamber 70 is basically the same as that described above relative to the system 100, with the difference being that the fuel vapor control valve 116 has been omitted and a balance air valve 128 is now mounted in the connection of the air balance lines 58 with the horn 48 of the carburetor 34. When the balance air valve 128 is closed, supercharged air arriving at the air horn 48 of the carburetor 34 will prevent the diaphragm of the diaphragm and metering valve assembly 47 from opening the metering valve so as to permit flow of gaseous propane into the carburetor. Thus, the flow of fuel for the main fire in the combustion chamber 70 is controlled by opening the solenoid-controlled, fuel lock off valve 112 and the balance air valve 128, with opening of the latter resulting in the nullification of the affect of the supercharged air on the diaphragm and metering valve assembly 47 so that the flow of gaseous propane into the carburetor is metered in accordance with the pressure drop across the diaphragm. With the presence of the balance air valve 128, the small amount of fuel stored between the solenoid-operated fuel lock off valve 112 and the converter units 52 is not allowed to flow until the balance air valve 128 is opened. It is noted that the same result can be achieved by using the valve 128 to control a coupling of the vaporized fuel line 114 with the atmosphere. Further, it is possible to omit the balance air valve 128 altogether in which case the small amount of fuel stored between the fuel lock valve 112 and the converter units 52 will flow in response to air flow through the carburetor 34 since such air flow will result in the diaphragm-controlled metering valve of the assembly 47 being opened.

Figure 6:
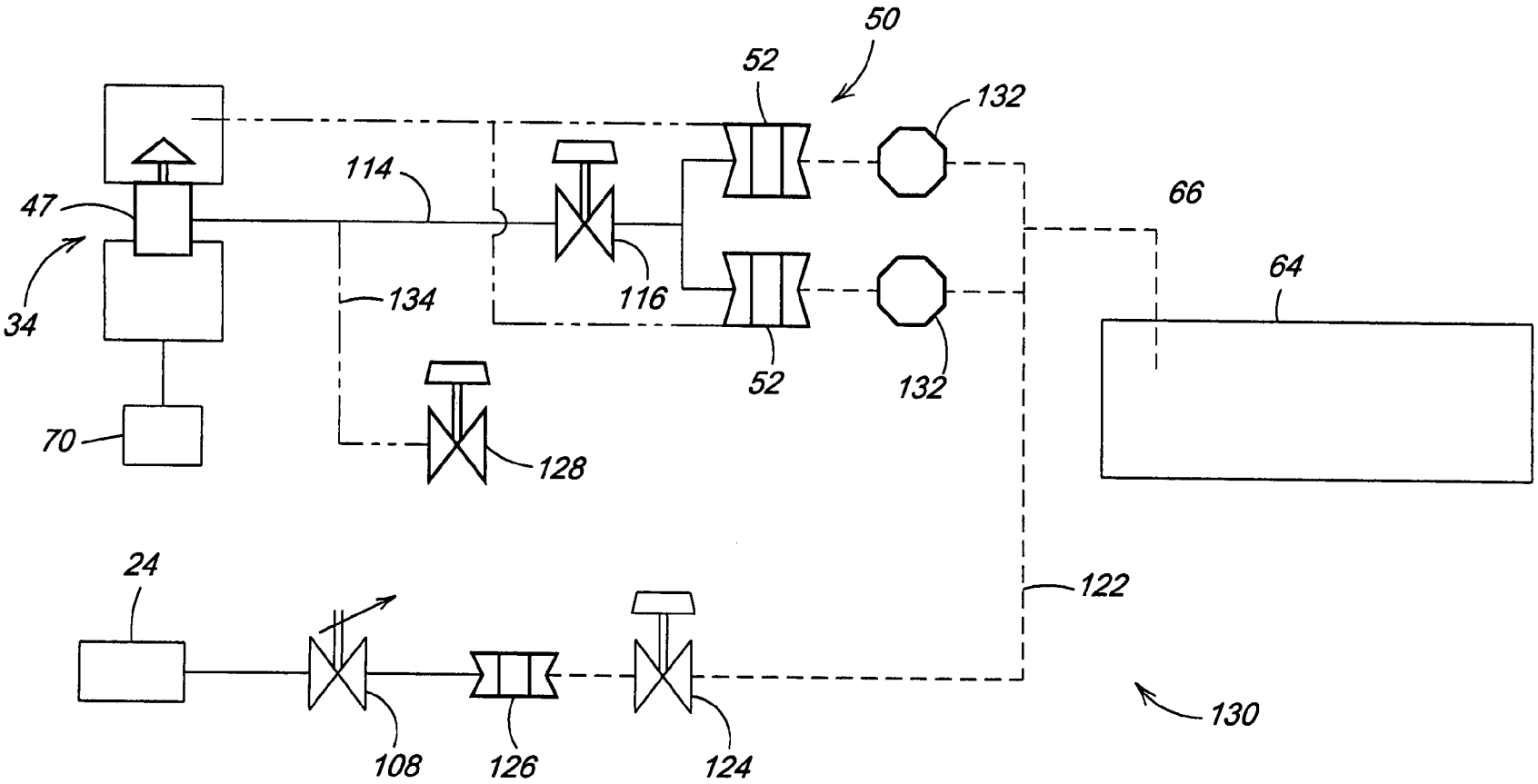

Referring now to FIG. 6, there is shown a further fuel control system 130 which is a variant of the control system 120. The major difference between the fuel control system 130 and the fuel control system 120 is that the solenoid-operated, fuel lock off valve 112 is removed from the line 66. Respectively located in the branches leading to the converter units 52 is a pair of vacuum-operated, fuel lock filters 132. Provided for use in conjunction with the fuel lock filters 132 is the balance line valve 128, which is removed from the line connecting the air balance lines 58 to the air horn of the carburetor 34 and, instead, positioned within an air balance line 134 extending from the vapor fuel line 114 which connects the converter units 52 to the carburetor 34. The fuel lock out filters 132 are fuel filter devices which prevent fuel flow unless a vacuum is applied to the device. When the valve 128 is open, a positive pressure exists in the system downstream of the fuel lock out filters 132 and results in a positive pressure being applied to the fuel lock out filters 132 so as to prevent fuel flow. Accordingly, fuel flow is permitted by closing the valve 128 so that the vacuum caused by air flowing through the carburetor 34 will be applied to the fuel lock out filters 132.

The operation of the steam generator assembly 10 is thought to be clear from the foregoing description and is not reiterated here for the sake of brevity. Suffice it to say that the metering valve assembly 47 of the carburetor 34 acts to vary the amount of fuel metered into the carburetor in response to changes in the amount of air flow through the carburetor and that this air flow can advantageously be changed by varying the output of the of the air pump 40. Therefore, over a given range, the firing rate of the burner is infinitely adjustable.

It is also an advantage that the process water used in cooling the steam generator body 12, elbow 20 and burner head 16 is also used as a source of heated fluid that is routed through the converter units 52 so as to impart sufficient heat to vaporize the liquid propane since the heated water is close at hand requiring only short hoses for its routing and is heated at no extra expense.

Finally, the fact that the carburetor 34 and all of the components used in the fuel systems 100, 120 and 130 are off-the-shelf components used in the automotive industry is advantageous since it results in parts which are less expensive than if they had to be specially manufactured. It is here noted that all of the fuel control components described above may be purchased off the shelf from various vendors of which Impco Technologies, Inc. and Woodward are examples.

Having described the preferred embodiment, it will become apparent that various modifications can be made without departing from the scope of the invention as defined in the accompanying claims.

ASSIGNMENT

The entire right, title and interest in and to this application and all subject matter disclosed and/or claimed therein, including any and all divisions, continuations, reissues, etc., thereof are, effective as of the date of execution of this application, assigned, transferred, sold and set over by the applicant(s) named herein to Deere & Company, a Delaware corporation having offices at Moline, Ill. 61265, U.S.A., together with all rights to file, and to claim priorities in connection with, corresponding patent applications in any and all foreign countries in the name of Deere & Company or otherwise.

What is claimed is:

1. A direct-fired steam generator, comprising: a combustion chamber including an air/fuel mixture inlet at one end and a combustion gas/steam outlet at an opposite second end; a carburetor having an outlet end connected to said inlet and including a combustion air inlet and a fuel inlet; a source of air being coupled to said air inlet; a source of fuel, said source of fuel including a tank containing liquid propane; a source of heated liquid, a converter arrangement coupled for receiving liquid propane from said tank and for receiving heated liquid from said source of heated liquid, with the converter using heat from said heated liquid to change said liquid propane to gaseous propane, and said converter arrangement including a gaseous fuel outlet being connected to said fuel inlet; and said carburetor including control structure operative for metering fuel into said carburetor from said fuel inlet in accordance with the amount of air passing through said carburetor.

2. The direct-fired steam generator, as defined in claim, 1 wherein at least said combustion chamber is surrounded by a water jacket; a water pump being connected for delivering a source of process water to said water jacket; said process water being said source of heated liquid coupled to said converter arrangement, with said coupling being done by a water line coupled for receiving heated water from said water jacket and for delivering said heated water to said converter arrangement; and said converter arrangement including an outlet coupled for conveying said process water to a region substantially at said outlet of said combustion chamber.

3. The direct-fired steam generator, as defined in claim 1, and further including a pilot burner assembly coupled to said combustion chamber at a location adjacent said inlet; said source of fuel including a tank containing both liquid and gaseous fuel with said pilot burner being coupled to said tank so as to receive only gaseous fuel from said tank.

4. The direct-fired steam generator, as defined in claim 1, wherein said source of air is provided by a variable air supply device.

* * * * *

UNITED STATES PATENT AND TRADEMARK OFFICE

CERTIFICATE OF CORRECTION

PATENT NO. : 7,007,636 B2
APPLICATION NO. : 10/883866
DATED : March 7, 2006
INVENTOR(S) : Walter Mark Schlesser et al.

It is certified that error appears in the above-identified patent and that said Letters Patent is hereby corrected as shown below:

On Title Page, Col. 1 Item (75)
Inventor, Walter Mark Schlesser, is mispelled. Please not the correct spelling of the inventor's name should be:

WALTER MARK SCHLESSER

Signed and Sealed this

Eighth Day of August, 2006

JON W. DUDAS
*Director of the United States Patent and Trademark Office*